US005533306A

United States Patent [19]

Aspenson

[11] Patent Number: 5,533,306

[45] Date of Patent: Jul. 9, 1996

[54] CONSTRUCTION PANEL SECTIONS WITH CONCEALED OPEN REGIONS

[76] Inventor: Daniel L. Aspenson, W5718 Hypoint Dr., La Crosse, Wis. 54601

[21] Appl. No.: 218,998

[22] Filed: Mar. 29, 1994

Related U.S. Application Data

[63] Continuation of Ser. No. 999,006, Dec. 31, 1992, abandoned.

[51] Int. Cl.[6] ..... E04B 1/82

[52] U.S. Cl. ..... 52/144; 52/506.06

[58] Field of Search ..... 181/150, 284, 181/290, 291, 292, 151, 199; 160/371, 379; 52/506.06, 507, 663, 144, 145, 656.7, 656.8

[56] References Cited

U.S. PATENT DOCUMENTS

| | | | |
|---|---|---|---|
| 1,480,298 | 1/1924 | Pearson | 160/380 |
| 1,554,180 | 9/1925 | Trader | 52/144 |
| 1,703,011 | 2/1929 | Mazer | 52/144 |
| 2,316,526 | 4/1943 | McDonald | 160/371 |
| 2,362,859 | 11/1944 | Rosenblatt . | |
| 2,410,413 | 11/1946 | Hurley . | |
| 2,413,568 | 12/1946 | Hurley | 181/33 |
| 2,830,330 | 4/1958 | Heath . | |
| 3,121,259 | 2/1964 | Versen | 52/28 |
| 3,553,942 | 1/1971 | Harrington et al. | 55/493 |
| 3,666,040 | 5/1972 | Junk | 181/150 |
| 3,729,205 | 4/1973 | Kwok | 277/227 |
| 3,757,479 | 9/1973 | Martinez | 52/222 |
| 3,903,660 | 9/1975 | Akins | 55/276 |
| 3,977,933 | 8/1976 | Sadashige | 156/250 |
| 3,986,850 | 10/1976 | Wilcox | 55/385.2 |
| 4,013,846 | 3/1977 | Krawczak et al. | 181/150 |
| 4,048,885 | 9/1977 | Miyakita et al. | 83/38 |
| 4,063,391 | 12/1977 | Balinski et al. | 52/506.06 |
| 4,088,463 | 5/1978 | Smith | 55/385.2 |
| 4,123,621 | 10/1978 | Walker | 181/151 |
| 4,133,928 | 1/1979 | Riley et al. | 52/659 |
| 4,248,647 | 2/1981 | Herron et al. | 156/84 |
| 4,486,995 | 12/1984 | Allen et al. | 52/309.8 |
| 4,607,466 | 8/1986 | Allred | 52/144 |
| 4,611,445 | 9/1986 | Pressley | 52/144 |
| 4,923,032 | 5/1990 | Nuernberger | 181/150 |
| 5,009,043 | 4/1991 | Kurrasch | 52/145 |
| 5,206,464 | 4/1993 | Lamn | 181/151 |

FOREIGN PATENT DOCUMENTS 1108046 6/1954 France .

*Primary Examiner*—Carl D. Friedman
*Assistant Examiner*—Yvonne Horton-Richardson
*Attorney, Agent, or Firm*—M. Paul Hendrickson

[57] ABSTRACT

The invention provides a panel section having an internally disposed open region concealed by a flexible member possessing sufficient porosity to be permeable to a flow of air therethrough. The panel section may be made by cutting an opening from an acoustical ceiling tile panel and then covering the opening with a porous and flexible member such as a cloth piece. The porous and concealed opening allows for detectable substances from utilities such as air, light and audio waves to pass through the flexible member and opening of the panel section. The panel sections are particularly useful in concealing utilities in suspended ceiling systems from view. The decorative patterns, styles, colorings, finishes, and decor of the permeable panel sections of this invention are distinctly unique.

15 Claims, 4 Drawing Sheets

CONSTRUCTION PANEL SECTIONS WITH CONCEALED OPEN REGIONS

This application is a continuing application of Ser. No. 07/999,006, filed Dec. 31, 1994, now abandoned.

FIELD OF THE INVENTION

The present invention pertains to construction panels and more particularly to prefabricated construction panel sections equipped with a concealed opening and the manufacture thereof.

BACKGROUND OF THE INVENTION

Acoustical ceiling tile or panel sections are customarily used in the construction of suspended ceilings in residential, public, and commercial buildings. In almost all constructions, an opening for securing a ceiling accessory such as a lighting fixture, sound speaker, sprinkler head, security camera, air vents (e.g. fans, air conditioning, heating, etc.) is required to complete the ceiling construction. The customary procedure is to simply cut an opening from the tile or panel and then cover the opening with an inflexible covering (frequently referred to as a grille) for the particular ceiling accessory. The coverings are typically made of unattractive, rigid materials such as metal, plastic or wood. Such conventional coverings are readily discernable colorwise and structurally from the ceiling tile panel section itself.

The patent literature abounds with teachings directed towards the manufacture of acoustical tiles which absorb, alter or prevent the transmission of sound waves or other substances therethrough. Such illustrative prior patent teachings include U.S. Pat. No. 4,248,647 to Herron et al which discloses an acoustical ceiling tile covered with a non-porous decorative plastic film. The tile is made by initially stretching a thin decorative film over an acoustical base in the form of a picture frame surrounding a recessed area, and adhesively securing the film to the side and/or back of the acoustical base and then heat shrinking the continuous film to produce a distortion free decorative surface thereupon.

In U.S. Pat. No. 4,607,466 to Allred there is disclosed an acoustical panel which has a porous layer directly bonded onto a rigid layer. Reference is also made to U.S. Pat. No. 5,009,043 to Kurrasch which discloses an acoustical panel formed upon an open frame, wherein at least one septum is centrally located within the frame opening and in contact with the frame members. The Kurrasch panels may be covered with a decorative fabric or a synthetic sheet material. U.S. Pat. 4,611,445 to Pressley discloses a ceiling panel of mineral wool fibers mixed with lithium carbonate, wherein a decorative surface is attached thereto for exposure to a room's interior. In U.S. Pat. No. 4,377,059 to Kuhr, there is disclosed a ceiling system in which at least one ceiling tile includes a removable central portion for covering an opening in tile. The opening is made by a high pressure fluid set cutter which provides a substantially vertical fine cut of a width no greater than .020 inches. The removable central portion is disclosed as consisting of the cut out section of the tile uniformly cut at a tight tolerance vertical cut (e.g. less than 0.02 inches) so as to freely interchange with other cut out tile sections. Spline members attached outwardly from the vertical cut and resting upon surface of the ceiling tile support the removable central portion upon the back-side peripheral margin of a centrally disposed opening or hole within the tile so as to cover the opening thereby. The removable central portion is described as being vertically demountable in that it may be raised so as to disengage the spline member from the tile upper surface, if desired, and slid edgewise through the opening. The open portion may be covered by a translucent material such as a light shielding lens for lighting fixtures, a foraminous material for an air distribution system, and a protruding or recessed shielding to provide a raised or recessed ceiling effect. U.S. Pat. No. 2,362,859 to Rosenblatt discloses an acoustical tile having a number of surface openings which communicate into a chamber filled with a sound absorbing material.

The patent literature fails to appreciate that suspended ceiling panel sections possessing acoustical absorbing qualities, may be of a construction which includes as part of its integrated structure a concealed porous opening permeable to the transmission of detectable or measurable substances therethrough. None of the aforementioned patents pertain to the. transmission of materials such as signals, heat, circulating air (e.g. air conditioned or heated forced air), sound, light waves through an acoustical panel section which includes as an integral part of its structure a flexible, camouflaging member which ocularly conceals an open or porous region of the acoustical panel section. If it becomes necessary to transmit any matter (albeit in the form of light or sound waves, air movement, such as in air conditioning, heating, venting, humidifying, electronic surveillance, etc.), the prior art solution typically entails covering a ceiling opening with an open grid or grille of a substantially rigid construction. A supple camouflaging member permeable to the transmission of detectable substances therethrough circumscribed or bordered by an acoustical tile frame and secured thereto would not only afford a more aesthetic permeable acoustical tile but also allow for unique functional uses heretofore not feasible under conventional acoustical ceiling tile practices.

SUMMARY OF THE INVENTION

The present invention is directed towards a construction panel section such as an acoustical tile section possessing a combination of acoustical absorbancy and conductance attributes within zoned regions of the panel section. The panel section includes an internally disposed open region bordered by sidewalls margining onto a peripheral acoustical framework and a camouflaging member permeable to the transmission of detectable substances therethrough covering the open region and being securely affixed onto the framework. The camouflaging member possess sufficient permeability or porosity so as to permit the transmission of detectable substances such as wave lengths of an invisible length (e.g. such as sound or light waves) through the open region of the panel section.

The panel sections may be prepared by initially cutting an internally disposed apertured opening from a conventional acoustical tile section. This provides an external framework having internally disposed sidewalls defining and margining onto the apertured opening. A supple member such as a fabric of a standard textile weave may then be utilized to cover the opening. The porous structure of the fabric allows detectable substances to be transmitted therethrough while also concealing the opening from ocular view. The fabric may be secured to the framework by a retaining ring fitted with a compressible gasket of a peripheral size and configuration sufficient to interface onto the internally disposed sidewalls of the cut-out region of the panel section. The retaining ring tautly stretches the fabric across the opening while also biasing and wedging the fabric against the framework.

If desired, a textural spray paint may be applied to facially overcoat the fabric, the framework or both. The facial overcoat substantially conceals the camouflaging member and the open region from view while also permitting the framework to be coated with the same overcoat as the camouflaging member. As a result, the open region simulates the appearance of the framework (e.g. color, texture, pattern and finish) while also visually concealing the opening from view. If desired, contrasting or complimentary patterns, colors, and finishes may be incorporated into construction panel sections of this invention for purposes of tailoring the decor to compliment a certain room decor. When used in sound systems, the fabric and painted overcoat layer upon the fabric retains sufficient sound permeablity to permit for the transmission of substantially unaltered sound waves through the painted fabric while also camouflaging the generating source of sound waves from view.

DETAILED DESCRIPTION OF THE INVENTION

Figure 1:
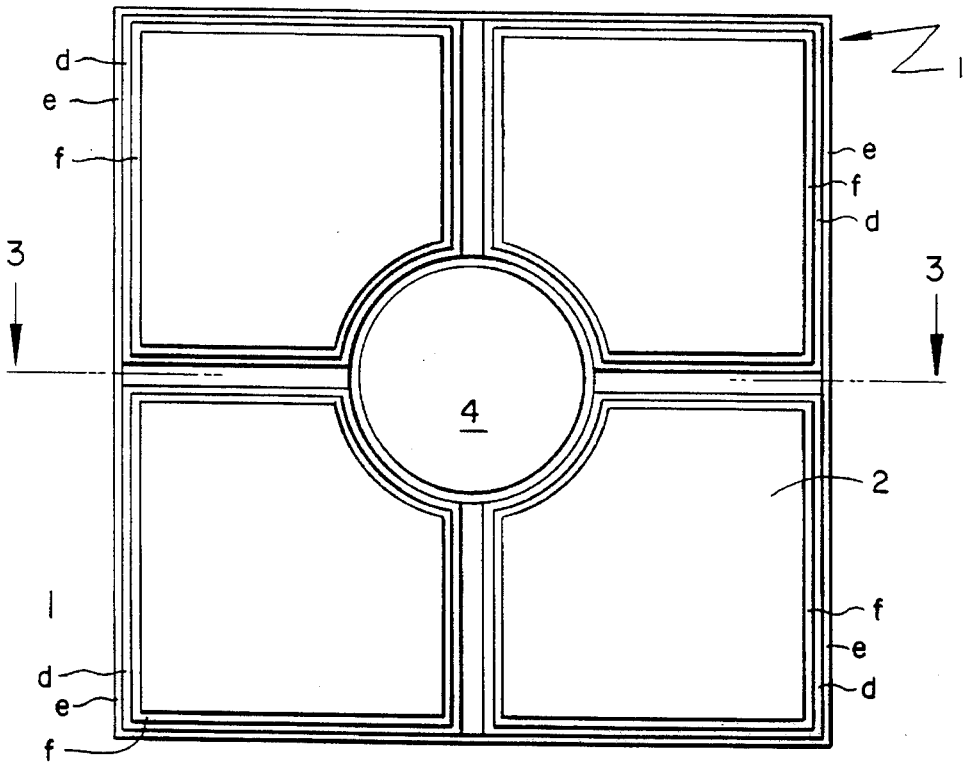
FIG. 1 facial view showing a construction panel section of this invention equipped with a sound wave transmitting member permeable to the transmission of sound waves therethrough while camouflaging from view an open region which houses an audio speaker.
Figure 2:
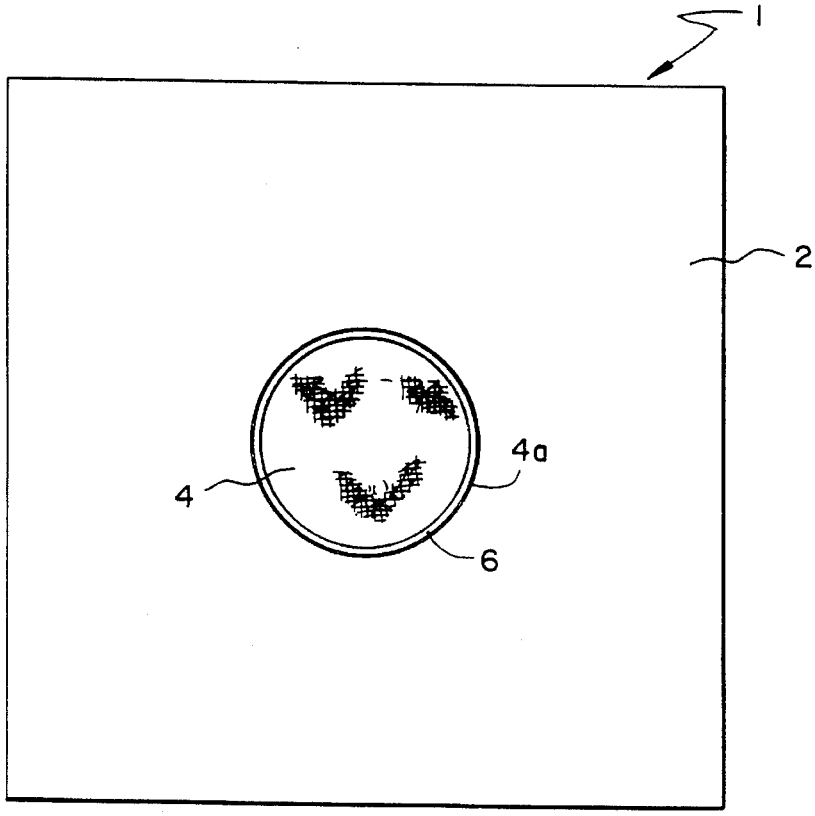
FIG. 2 is a back view of FIG. 1

As may be observed from FIGS. 1–7, the invention provides a construction panel section 1 comprised of an acoustical absorbing frame (generally designated as 2), an apertured region or opening 3 (e.g. see FIG. 3) internally disposed within said frame 2 and a porous, concealing member (generally designated as 4) permeable to the transmission of detectable substances and which conceals opening 3.

The present invention provides a prefabricated or preassembled construction panel section 1 of a unitary construction which includes an acoustical absorbing zone (i.e. frame 2) and a camouflaged or concealed zone (i.e. 4) possessing sufficient permeability so as to permit the passage of a detectable substance through the panel section 1. The decor, color, finish, pattern, and/or textural character of camouflaged zone 4 may be fabricated so as to match that of the acoustical panel section 1 or alternatively to create a contrasting or complimentary decor while also providing the desired functional utility of allowing passage of detectable substances through zone 4.

The camouflaging member 4 ocularly conceals an open region 3 of panel section 1 from view. The porosity of camouflaging member 4 may be tailored so as to meet the transmission requirements for a broad scope of detectable substances (e.g. substances of a tangible or measurable form) such as vented or forced air (e.g. sterilized, heated, cooled, air conditioned, humidified, dehumidified, scented, etc. air), sound waves, light or video waves (transmittable and receivable such as by electronic surveillance), infrared waves, etc. The covering member 4 will typically comprise a material of sufficient porosity so as to permit the passage of light and/or sound waves therethrough while also concealing the emitting source from view. The camouflaging member 4 will preferably possess sufficient porosity so as to permit a flow of forced air therethrough. Advantageously, the camouflaging member 4 will be constructed of supple materials which ocularly conceal the opening 3 while also possessing sufficient permeability to permit transmission of ordinary sound waves therethrough without substantially altering or changing the character of the transmitted sound waves.

FIGS. 1–4 depict an adaptation of this invention to a construction panel section 1 equipped with a speaker grille (as the camouflaging member 4) which may be a different or of a same color, pattern, finish, and/or texture as the rest of the panel section 1. The construction panel section 1 comprises a peripheral framing unit 2 (which may be cut from a conventional acoustical panel section), an opening 3 disposed within the framing unit 2, a flexible or supple material **4*a* permeable to sound and a means for securing (generally referenced as 6 and depicted as a retaining band 6) the flexible material 4*a* onto the framing unit 2. The invention permits camouflaged zones 4 of uniquely different designs, stylistic patterns, colorings, finishes, and textures of a similar or contrasting character to be directly incorporated into a prefabricated panel section 1 for later installation at a construction site. Unlike conventional sections and coverings, the framing unit 2 and covering member 4 may appropriately create an appearance of a panel section 1** of a unitary and single piece construction.

Conventional acoustical panel sections provided with an open region 3 cut therefrom may provide an appropriate precursor for framing unit 2. Such conventional acoustical panel sections are typically provided in various different sizes (e.g. 2'×2', 2'×4', 2'×5', 20"×60", etc.) and thicknesses (e.g. ½", ⅝", ¾",etc.). These acoustical panel sections are typically constructed of a fire retardent mineral-fiber composite faced with a variety of different decorative surfaces.

Figure 7:
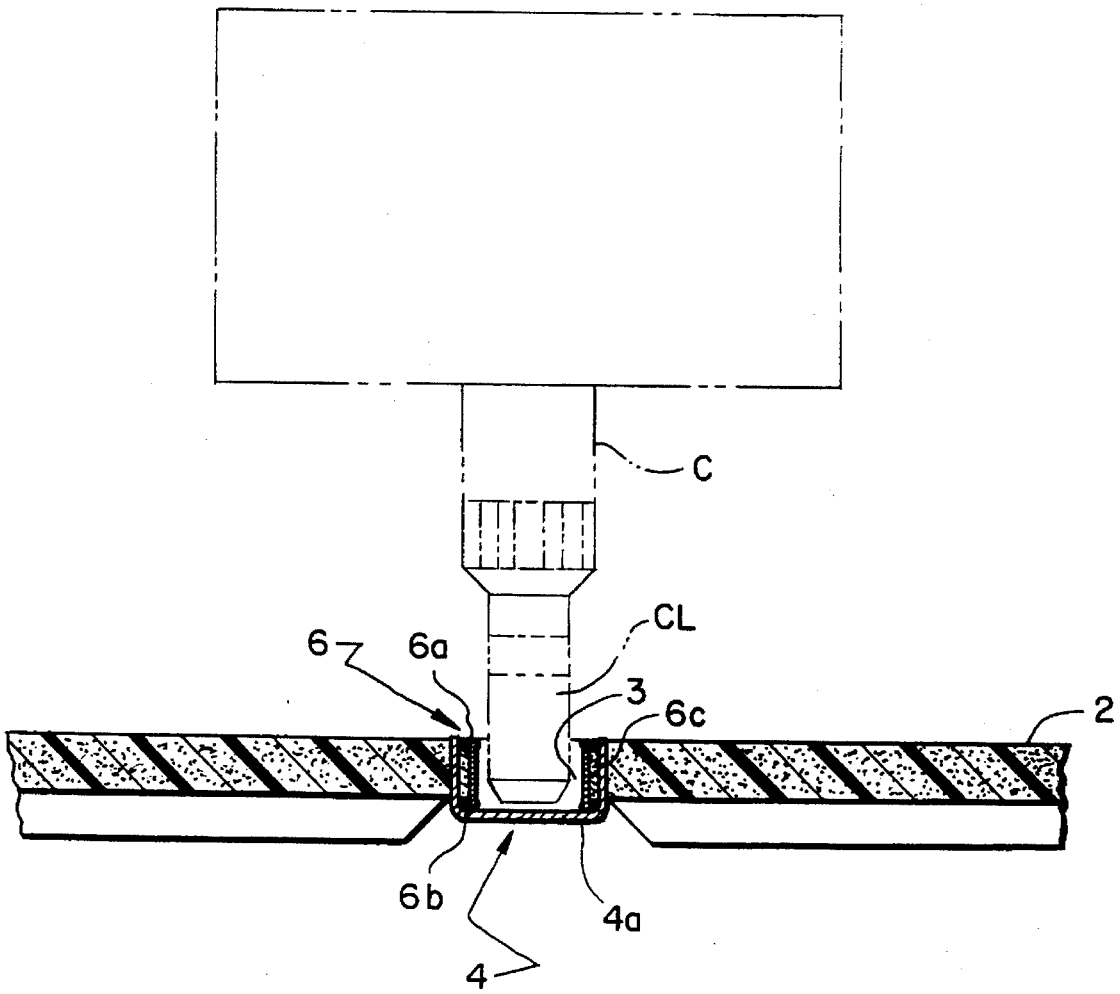
FIG. 7 shows a cross-sectional view of a construction panel of this invention adapted for use in concealing a surveillance camera from view.

The desired stylistic pattern or decor, the size and shape of open region 3 within framing unit 2 may be tailored so as to meet a functional requirement of the particular appliance or accessory to be concealed by concealing member 4. The shape of opening 3 may be accordingly varied (e.g. square, rectangular, oblong, oval, logo, symbolic, and/or identifiable object shapes, etc.) as desired to accomplish a desired functional and aesthetic effect. The opening 3 may accordingly range in size from a centimeter squared or less (e.g. such as for a concealed surveillance pinhole camera C as depicted in FIG. 7 or for pinhole lighting use) to an opening 3 covering substantially all of the total surface area of panel section 1 except for a sufficient peripheral margin of framing unit 2 to retain and support concealing member 4. Illustrative hidden accessories often requiring a larger surface area include certain lighting fixtures L (e.g. fluorescent lighting) which may require an open region 3 amounting to 95 percent or more of the total surface area of panel section 1. In contrast, the audio speaker S, and the lighting fixture L concealments of FIGS. 1–5, and the pin. hole opening for the concealed surveillance camera C of FIG. 7 are depicted as requiring an open region 3 typically amounting to less than 25 percent of the total surface area of panel section 1. For most applications, the surface area covered by flexible material 4a will range in size from about 1" (inch) to about 20" (inches) and most typically range from about 4" to about 12" opening size.

Figure 3:
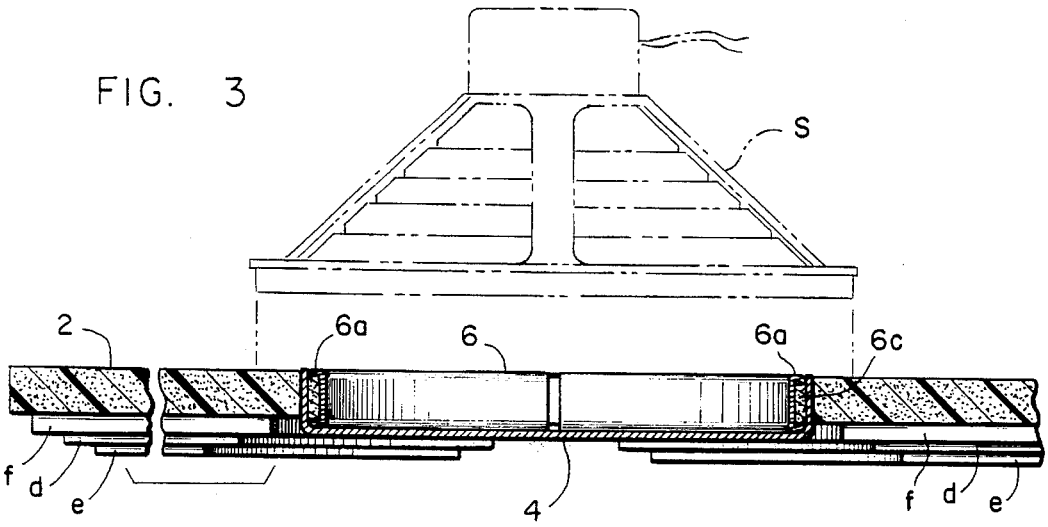
FIG. 3 is a cross-sectional view taken along line 3—3 of FIG. 1.
Figure 4:
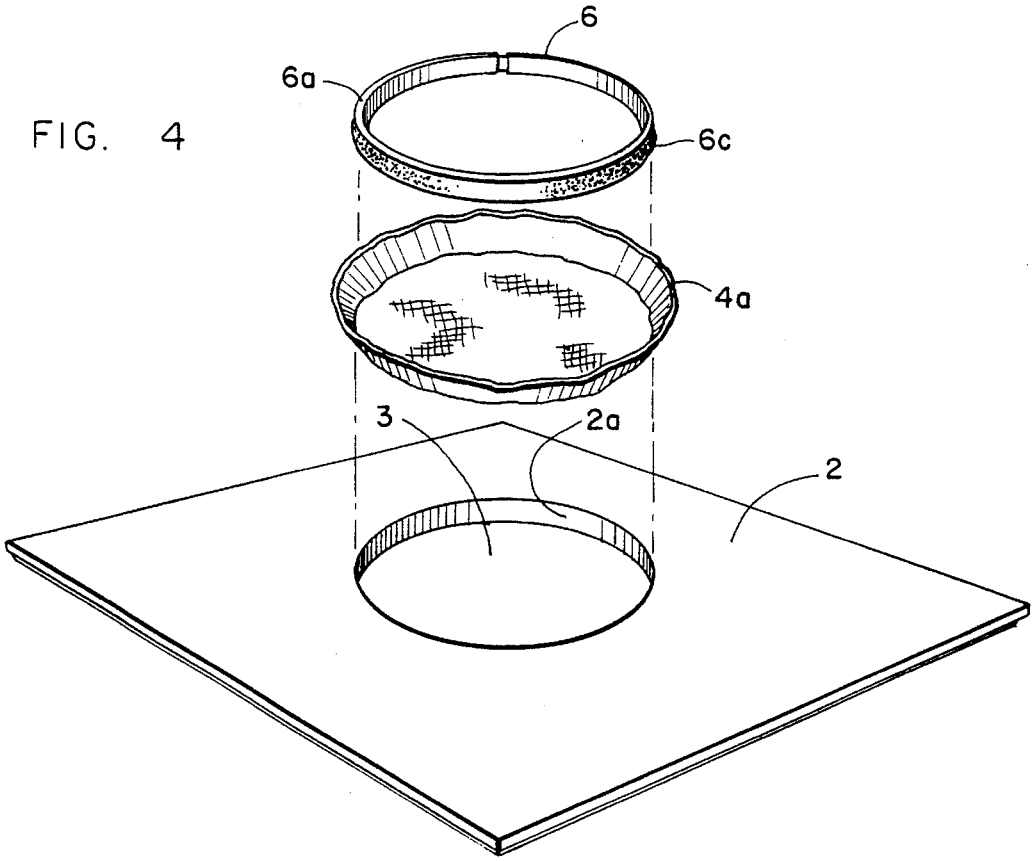
FIG. 4 shows greater detail certain structural components of section depicted in FIG. 1.

In making the speaker grille panel section 1 as depicted in FIGS. 1–4, an internally disposed aperture 3 defining a passageway 3 of a size sufficient to allow for passage of sound from an audio source (e.g. such as emitted by a six-inch, circular speaker S hidden behind the panel section 1 as depicted in FIG. 3) is internally cut from a conventional acoustical panel section so as to form acoustical framing unit 2. A pliable and porous camouflaging member 4 may be used to effectively conceal open region 3 from direct ocular view. Advantageously, panel section 1 also includes means 6 for securing the camouflaging member 4 onto panel section 1. The panel sections 1 may be manufactured at the factory site so as to include, if desired, acoustical speaker boxes for acoustically housing the speaker S and for improving upon the sound quality generated by the audio system.

A band 6 is depicted in FIGS. 1–5 and 7 as an appropriate means for securing the fabric 4a onto the framing unit 2. Band 6 suitably has a peripheral size and shape so as to interfacially bias fabric 4a onto the sidewalls 2a of framing unit 2 and secure the fabric 4a onto panel section. In making section 1, a flexible material 4a (preferably a supple meshed material) of a size sufficient to overlap onto the sidewalls 2a, and correspondly onto the interfacing edges of band 6, is overlappingly placed onto band 6. Band 6 may then be inserted into opening 3 so as to tightly stretch the flexible material 4a across the face of band 6 while also tightly biasing or wedging the flexible material 4a against the bordering sidewalls 2a of aperture 3. Once inserted, band 6 firmly secures or wedges flexible material 4a onto the sidewalls 2a of framing unit 2.

The camouflaging member 4 advantageously includes a flexible material 4a composed of a multiplicity of porous openings which may vary in size, shape, and number of openings. The flexible material 4a may be effectively utilized to create a covering member 4 precursor that more closely aesthetically matches the texture, finish, pattern, and decor of the acoustical panel section of framework 2. The flexible material 4a is preferably of a meshed or screen construction, the opening of which may be tailored in size, shape, and mesh so as to meet the desired end use. The flexible material 4a may be appropriately comprised of wire, plastic, or cloth material ranging form a relatively coarse mesh (e.g. opening of about a ½ inch or more) to finer meshed (e.g. 400 U.S. mesh having a 0.03 mm opening size or smaller) materials. The most appropriate selection of fabric 4a mesh and size is typically dependant upon the percentage of open area per square inch necessary to accomplish the particular requirements of any given sound, light, air, security, etc. system to function while still obscuring opening 3 from view. The weave or mesh of fabric 4a may also be effectively used to control the size, shape, and number of porous openings within the camouflaged member 3 as well as the textural attributes of the finished panel section 1. Tightly weaved fabrics tend to reduce the opening size while also increasing the total number of porous openings within the fabric. Conversely, a more loosely weaved fabric yields larger sized openings of a lesser number.

The flexible material 4a will advantageously comprise a pliable or supple material 4a which (in contrast to rigid materials) may be shaped and reshaped so as to conform to a desired concealing position within section 1. The supple material 4a will preferably possess sufficient pliability so as to permit its being bent at a 90 degree angle (along both a straight or curvilinear line) and thereafter repositioned to its original position before bending without revealing any ostensible evidence of the material 4a being previously bent at a 90—degree angle. The flexible materials 4a utilized herein will also preferably possess an inherent capacity to gravitationally conform to a contour of mandrel formed by two planer surfaces converging at 90 degrees onto an apex. Clothes, plastic screen (such as NYLON screens), cellulosic materials are exemplary materials which typically when emplaced upon such an apexed mandrel will gravitationally follow such a contoured surface without requiring an external physical force to bend the material about the apex of the mandrel. Wire screens, inflexible plastic and metal grilles are exemplary materials which would typically fail to conform to the configurations of such a mandrel test. Most preferably the flexible material 4a possess sufficient flexibility and pliability so as to be folded and refolded onto itself and then readily unfolded, and when thereafter placed onto a flat surface will conform to the contour of the flat surface.

The flexible material 4a affords exceptional versatility in creating uniquely different coverings for concealed open regions 3 of panel section 1. The flexible material 4a as utilized in this invention will advantageously possess a fibrous or filamentous structure having a relatively high order of porosity or open structure such as commonly indigenous to natural and synthetic textile fabrics. The flexible materials 4a as applied herein will also advantageously be of a type receptive to pigmentation, dyes, coloring, etc. These attributes permit coloring or printing (e.g. such as by silk screening, painted upon, etc.) upon the flexible material 4a so as to afford uniquely different coverings 4 for open zone 3. The porous and fibrous structure of such fabrics (as opposed to the flat and relatively non-porous or non-fibrous surfaces of smooth or polished surfaced metals and plastics) provides a more penetratable material for permanently impregnating and coating the flexible material 4a via a camouflaging overcoat 9 or by printing, silk screening, etc. techniques. Conventional textile fabrics such as used in the manufacture of clothing, linens, etc., are especially well adapted for use as a flexible member 4a herein.

The application of a finishing coat or overcoat 9 onto flexible material 4a (as depicted in the expanded view of FIG. 6) and, if desired, onto the framing unit 2 may be effectively utilized to significantly enhance the aesthetic appearance of panel section 1. If desired, both the framing unit 2 and flexible material 4a may be facially overcoated by spray painting a textural paint of an appropriate coloring onto the framing unit 2 and concealing member 4. Overcoating of the entire panel section 1 creates an appearance of a uniformly colored, textured, and patterned panel section 1 having an open region 3 concealed from ocular view. The finishing coat 9 applied onto flexible material 4a may also be designed to match onto textural character of the framing unit 2. Overcoat 9 may also be used to effectively cover and conceal the interfacing juncture between fabric 4a and sidewalls 2a. Since the finishing overcoat 9 may be commonly applied as an overcoating for the flexible material 4a, band 6 and framing unit 2 (including the interfacing juncture therebetween), panel sectior 1 may be made so as to appear comparable to any other panel section of an integral construction. Alternatively, the framework 2 and camouflaging member 4 may be of a differing color, pattern, finish, and/or texture so as to compliment the decor and/or furnishings of a room. Such a contrast in decor may be achieved, if desired, by painting the different regions or parts of panel section 1 differently.

The meshed characteristics of flexible member 4*a* in conjunction with overcoat 9 may also be collectively combined to control the permeability or porosity of the camouflaging member 4 relative to the transmission or conductance of detectable substances therethrough. For example, if it is desired to minimize pore size, then a more tightly weaved fabric with the same thickness of overcoat 9 will generally yield smaller sized openings than a less tightly weaved fabric. Conversely, overcoat 9 may also be effectively used to coat and control the meshed opening size of the fabric. Overcoating paints formulated with fibrous materials or other particulated macroscopic objects such as conventionally used to produce highly textured paint finishes may, if desired, be combined with the more open weaves so as to reduce the opening size or create a more closed or tighter porous structure with indirect or tortuous passageway infrastructure leading onto an interiorly disposed open region. The painted overcoat 9, as applied to fabric 4*a*, may be utilized to substantially cover opening 3 or to partially cover the opening 3 while still retaining sufficient porosity within opening 3 to allow for the transmission of the desired detectable matter (e.g. such as sound or light) therethrough. In the preferred embodiments of the invention, commercially available flame retardent fabrics pre-coated with a texturizing finish (e.g. precoated fabrics by BGF Industries, Inc., such as Style 1963 of plain weave type with 18 ends/inch WARP and 16 picks/inch FILL, weight 4 of oz/yd$^2$, and 0.0110 inch (uncoated fabric) thickness; Style 1964, Leno weave type with 40 ends/inch WARP, 8 picks/inch FILL, weight 3.01 ounces/yards$^2$, and 0.0075 inch (uncoated) thickness; and Style 1965 of plain weave type with 32 ends/inch WARP, 24 picks/inch FILL, weight 3.2 ounce/yards$^2$ and 0.0060 (uncoated fabric) thickness are utilized as precursor for fabric 4*a*. After installing fabric 4*a* onto framing unit 2 with band 6, the face of fabric 4*a* and framing unit 2 may then be spray painted with sufficient paint so as to provide finishing coat 9 which matches colorwise and texturally the flexible member 4 onto framing unit 2.

A wide variety of paints may be utilized to provide the overcoat 9. Such paints are conventionally formulated with a volatile vehicle or liquid base (water or solvent base) which serves a liquid vehicle, a binder or film former which upon removal of the volatile base or vehicle forms a tenacious film coating, pigments or coloring agents, preservatives (e.g. fungicides, antioxidants, mildewcides, etc.), leveling agents, texturizing and finishing agents, thickeners, and other conventional additives which are uniformly dispersed within an organic and/or water based paints. In the preferred embodiments of the invention, the paint will have color and textural characteristics such as typically utilized in painting conventional acoustical panel sections.

Figure 5:
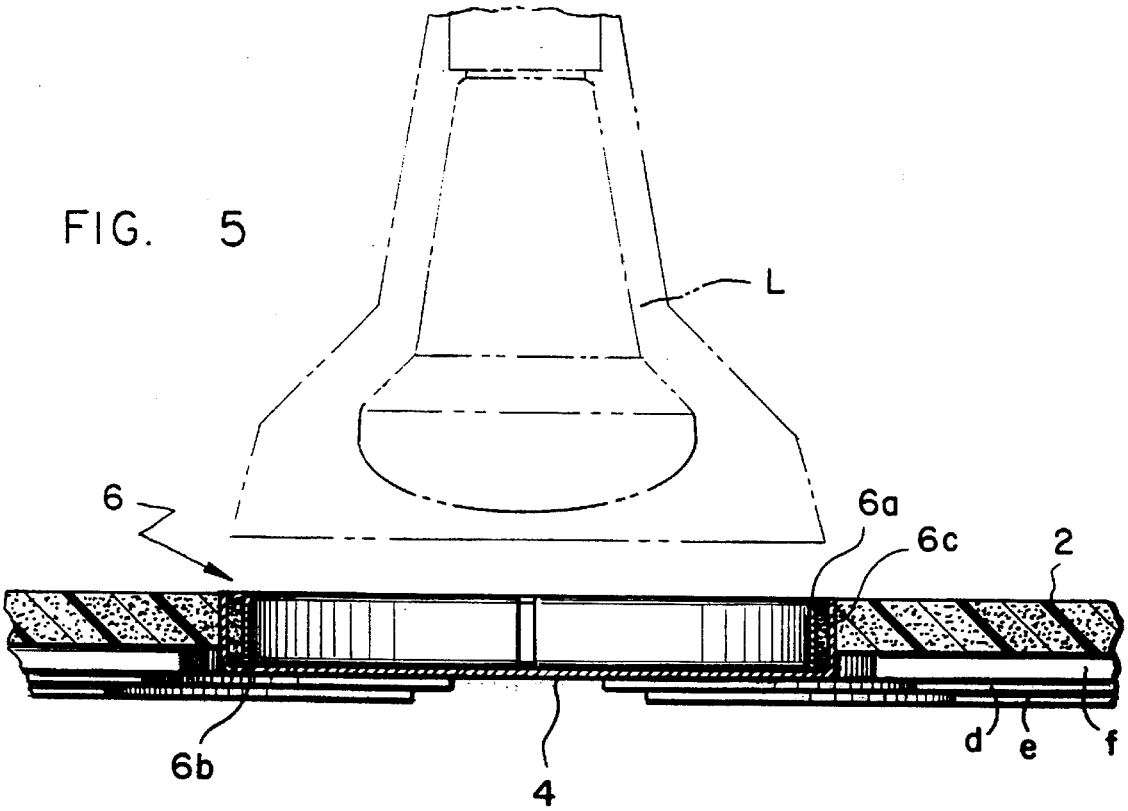
FIG. 5 depicts a cross sectional view of an construction panel section of invention for use in camouflaging a light transmitting source from view.

The framework 2 for acoustical tile section 1 equipped with a camouflaged speaker grille 4 as shown in FIGS. 1–4 may be fabricated from a standard mineral/fiber acoustical panel section such as one measuring 24"square and ¾" thick. A decorative pattern comprised of three steps (d, e, f) may be appropriately routed about the outer perimeter of the panel section and cut along the bisecting center lines of panel section 1 as shown in FIGS. 1, 3 and 5. The speaker grille 4 depicted in FIGS. 1–4 represent about a 17.5 centimeter diameter opening 3 cut from the center of the acoustical panel section to provide the desired framework 2 and opening 3 for concealing a 6—inch audio speaker S. A standard inner metal embroidering hoop measuring 17.5 centimeters O.D. with rolled rails 6*a* and 6*b* externally defining a channel circumferentially measuring 7mm wide and 3mm depth and equipped with cork gasket 6*c* inlay flushly filling the filled channel 6*c* to the outermost ridges of the rails 6*a* and 6*b* was used as a retaining band 6 to secure flexible member 4*a* onto section 1.

A pre-coated, fire retardent, cloth patch 4*a* (e.g. BGF Industries, Inc., 301 North Elm St., Greensboro, N.C. 27401, Style 1963 infra) of a size sufficient to overlap both rails 6*a* and 6*b* (e.g. measuring 19 centimeters square) was cut from a larger cloth piece. Cloth patch 4*a* was centered onto band 6 with overlapping fabric 4*a* tautly positioned across band 6, and band 6 was then forced into the opening 3 until the outermost edge of band 6 rested flushly with rear surface of framework 2. The compressible cork gasket 6*c* about the perimeter of band 6 firmly biases fabric 4*a* onto the sidewalls and secures fabric 4*a* onto framework 2. Excess fabric was then cut from the back side of band 6 so that the remaining fabric 4*a* and band 6 rested flushly with the planer surface of the rear side of framework 3 as shown in FIG. 3. The speaker grille 4 facially appears as a raised circular member 4 matching the elevation of step e as depicted in FIG. 3. The concealed member 4 may, as desired, be raised, recessed, or placed in planer alignment of the face of section 1. The opening 3 may likewise altered to any desired configuration (e.g. square, diamond, oblong, etc. shape) with band 6 or such other appropriate means for retaining the camouflaging member 3 onto section 1.

Employing a standard commercial paint sprayer loaded with a flat latex paint, (e.g. interior wall and ceiling painting type), the framework 2 and speaker grille 4 were evenly and uniformly painted with a finishing overcoat 9. The finishing overcoat 9 provides a uniform match in texture, color, and finish throughout the facial surfaces of the fabric 4*a* and framework 2. The resultant covering member 4 with integrated overcoat 9 hides, obscures, and camouflages opening 3 from view. Outwardly opening 3 is difficult, if not impossible to detect, but becomes visible when the grille is placed in line with a bright light (e.g.100 watt at five feet) source.

The cross-sectional view of FIG. 5 depicts another application of panel section 1 in which a hidden light source L is camouflaged from view. As may be observed from FIG. 5, the panel section 1 includes the same basic components of the panel section 1 as depicted by FIGS. 1–4. The panel section 1 of FIGS. 5 and 7 may be manufactured in substantially the same manner as the audio panels 1 except for modifying camouflaging member 4 so that it more effectively permits the passage of light therethrough. This may be accomplished by increasing the porosity of the camouflaging member 4 such as by selecting a more porous precoated flexible fabric 4*a* (e.g. BGF Industries, Inc., style 1964 finished fabric, Leno weave, 40 ends/inch WARP, 8 picks/inch FILL, 3.01 oz./square yard, 0.0075 inches thickness) and lightly spray painting the covering member 4 and framework 2 with a matching overcoat 9. The resultant covering member 4 provides an excellent lens for concealing light source L from view while allowing sufficient light to pass through member 4.

Figure 6:
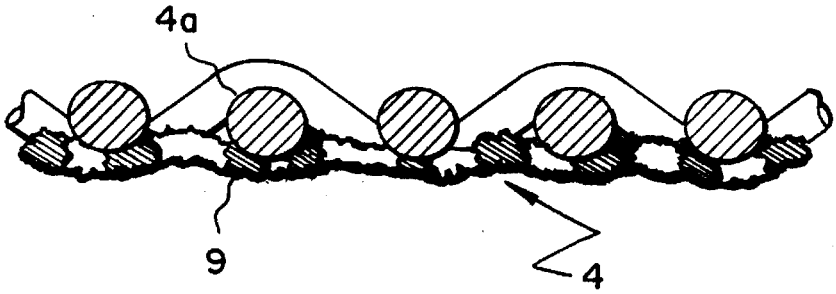
FIG. 6 is cross-sectional view taken along line 6—6 of FIG. 2.

FIG. 7 illustrates the adaptation of the invention to a panel section 1 fitted with a flexible member 4 for concealing a hidden surveillance camera C from view. The camera C is supportively secured underneath panel section 1. Similar to the panel sections 1 shown in FIGS. 1–5, the panel section of FIG. 7 includes a framing unit 2, an open region 3 of a substantially smaller size than the audio and lighting opening 3 of FIGS. 1–5, and a recessed flexible and porous member 4*a* secured to framing unit 2 by retaining band 6. Flexible member 4 and framing unit 2 may be coated with a thin overcoat 9 so as to camouflage the opening 3 from view as illustrated in FIG. 6. The camera lens CL of the surveillance camera C extends onto opening 3 of framework 2 in juxtaposition to flexible member 4*a*. The meshed weave of fabric 4*a* is selected and overcoated with overcoat 9 to cooperatively permit sufficient light waves to pass through fabric 4*a* for surveillance purposes. In a similar manner, the pinhole surveillance camera C may be replaced with a pinhole lighting fixture without any appreciable change in the design and construction of the panel section 1 as depicted in FIG. 7. FIG. 6 depicts in more detail a woven fabric 4*a* impregnated with a porous overcoat 9 of paint.

What is claimed:

1. An acoustical panel section adapted for installation onto a suspended ceiling fitted with an audio speaker which communicates onto the panel section, said acoustical panel section consisting essentially of an acoustical ceiling tile having an internally disposed open region which when installed onto the suspended ceiling affords a mating passageway communicating onto the audio speaker, an internal sidewall bordering onto the open region, a fabric piece tautly covering the open region, securing means securely affixing the fabric piece onto the sidewall and a facial overcoating of paint overcoated onto the fabric piece.

2. The panel section according to claim 1 wherein the ceiling tile includes a painted overcoat substantially matching in color and texture to the facial overcoating of paint overcoated onto the fabric piece.

3. The panel section according to claim 2 wherein said securing means comprises a band for wedging and biasing the fabric tautly against the sidewall.

4. The panel section according to claim 3 wherein the painted overcoat and the facial overcoating impart to the panel section an appearance of unitary construction.

5. The panel section according to claim 3 wherein the band includes a compressible cork gasket about perimeter of the band which firmly biases and secures the fabric piece to the sidewall.

6. An acoustical ceiling panel section equipped with a concealed opening permeable to lighting transmission with the concealed opening of the panel section being adapted for use in concealing a hidden ceiling utility from view, said panel section comprising an internally disposed open region porous to said transmission, a pliable concealing member permeable to said transmission covering the open region and concealing the concealed opening from ocular view, an external acoustical absorbing frame constructed of a mineral and fiber composite with said frame having an internally disposed sidewall bordering onto said open region and external peripheral margin for supportively securing said member onto said sidewall, and securing means securely affixing the member onto said sidewall.

7. The panel section according to claim 6 wherein the frame consists essentially of a fire retardant ceiling tile panel sized for installation onto a suspended ceiling.

8. The panel section according to claim 7 wherein the concealing member comprises a fabric and the securing means comprise a retaining ring which tautly wedges and secures the fabric onto said sidewall.

9. A method for manufacturing a construction panel section comprised of an internally disposed opening permeable to a transmission of sound therethrough, and concealed from ocular view by a flexible camouflaging member a peripheral acoustical absorbing framework bordering onto the opening, with the panel section being adapted for use in providing a passageway for communicating onto a utility fixture hidden from view beneath the panel section, said method comprising removing an internally disposed portion from an acoustical absorbing panel unit to provide an internally disposed open region disposed within said framework, covering the open region with the flexible camouflaging member permeable to the transmission of sound therethrough, and securing said camouflaging member onto said acoustical framework so as to conceal said open region from ocular view and thereby provide the construction panel section equipped with the concealed opening permeable to the transmission of sound therethrough circumscribed by said acoustical absorbing framework.

10. The method according to claim 9 wherein the removing of the internally disposed open portion from the acoustical absorbing member comprises cutting the internally disposed portion from an acoustical ceiling tile panel section consisting essentially of a fiber and mineral composite and the covering of the open region comprises placing a cloth piece within the open region.

11. The method according to claim 10 wherein removing the internally disposed portion comprises cutting the portion from the acoustical ceiling tile panel section to provide an internally disposed sidewall margining onto said open region and said framework.

12. The method according to claim 11 which includes the step of painting the cloth piece with paint.

13. The method according to claim 11 which includes tautly securing the cloth piece onto the sidewall.

14. The method according to claim 11 which includes tautly wedging and securing the cloth piece against the sidewall of the framework with a retaining ring.

15. The method according to claim 14 which includes painting the framework and the cloth piece with a pigmented overcoat of a matching color and texture.

* * * * *